US007123983B2

(12) United States Patent
Yogo et al.

(10) Patent No.: US 7,123,983 B2
(45) Date of Patent: Oct. 17, 2006

(54) SYSTEM AND PROCESS FOR CREATING CUSTOM FIT ARTIFICIAL FINGERNAILS USING A NON-CONTACT OPTICAL MEASURING DEVICE

(75) Inventors: Teruaki Yogo, Aichi-Pref (JP); Yong Li, LaSalle (CA); Kazuhiro Hoki, Canton, MI (US)

(73) Assignee: MiiC America, Inc., Canton, MI (US)

( * ) Notice: Subject to any disclaimer, the term of this patent is extended or adjusted under 35 U.S.C. 154(b) by 91 days.

(21) Appl. No.: 10/712,547

(22) Filed: Nov. 13, 2003

(65) Prior Publication Data

US 2004/0143359 A1 Jul. 22, 2004

Related U.S. Application Data

(60) Provisional application No. 60/425,952, filed on Nov. 13, 2002.

(51) Int. Cl.
*G06F 19/00* (2006.01)

(52) U.S. Cl. ..... 700/182; 700/161

(58) Field of Classification Search ..... 700/182, 700/233, 231, 161; 345/418–419, 619
See application file for complete search history.

(56) References Cited

U.S. PATENT DOCUMENTS

| | | | | |
|---|---|---|---|---|
| 4,645,348 | A | 2/1987 | Dewar et al. | |
| 5,175,601 | A | 12/1992 | Fitts | |
| 5,309,365 | A | 5/1994 | Sullivan et al. | |
| 5,493,502 | A | 2/1996 | Niwa | |
| 5,968,302 | A | 10/1999 | Gifford | |
| 6,035,860 | A | 3/2000 | Mombourquette | |
| 6,190,593 | B1 | 2/2001 | Baba | |
| 6,196,234 | B1 | 3/2001 | Gifford | |
| 6,328,949 | B1 | 12/2001 | Tessarolo et al. | |
| 6,382,217 | B1 | 5/2002 | Coker et al. | |
| 6,464,496 | B1 * | 10/2002 | Sachdeva et al. | 433/24 |
| 6,525,724 | B1 * | 2/2003 | Takami | 345/419 |
| 6,622,064 | B1 * | 9/2003 | Bartholomew et al. | 700/233 |
| 2001/0032654 | A1 | 10/2001 | Coker et al. | |

FOREIGN PATENT DOCUMENTS

EP 0 577 515 A1 1/1994

OTHER PUBLICATIONS

ISA/US International Search Report dated Apr. 15, 2004 regarding International Application No. PCT/US03/36380.

* cited by examiner

*Primary Examiner*—Zoila Cabrera
(74) *Attorney, Agent, or Firm*—Harness, Dickey & Pierce, P.L.C.

(57) ABSTRACT

A system and process for creating custom fit artificial fingernails using a non-contact measuring device is disclosed. A fingernail is measured for its topographical configuration by an optical non-contact measuring device. The measured topography of the fingernail is then used to direct a machining device to create an artificial fingernail. Also disclosed is a method to digitally design an artificial fingernail, which has a portion of its under surface fitted to the natural fingernail by using a special computer program. The three-dimensional shape information of the digitally designed artificial fingernail is then converted into machine codes to drive a computer numerical controllable device, which will then cut the artificial fingernail from a piece of raw material. Finally, the user selected nail art can be printed onto the artificial fingernail by using a nail art printing device.

18 Claims, 8 Drawing Sheets

SYSTEM AND PROCESS FOR CREATING CUSTOM FIT ARTIFICIAL FINGERNAILS USING A NON-CONTACT OPTICAL MEASURING DEVICE

CROSS-REFERENCE TO RELATED APPLICATIONS

This application claims the benefit of U.S. Provisional Application No. 60/425,952, filed on Nov. 13, 2002. The disclosure of the above application is incorporated herein by reference.

FIELD OF THE INVENTION

The present invention generally relates to creating custom fit artificial fingernails and specifically to a process and system for creating custom fit artificial fingernails using a non-contact measuring device for measuring a fingernail for custom fitting an artificial fingernail.

BACKGROUND OF THE INVENTION

Artificial fingernail tips, a desirable fashion (if not also functional) accessory, exist in various forms. A customized artificial fingernail can be made to fit the exact contour and dimensions of a natural fingernail. This offers considerable advantages in comfort, appearance, and durability over non-custom fit fingernails commonly available. However, custom fitting an artificial fingernail poses special challenges and problems. Commonly used methods for production of artificial fingernails are very labor intensive, time consuming and require significant skill.

One method for production of artificial fingernails is called "nail sculpturing." In this method a pre-made artificial fingernail tip is attached to the tip of a real finger by an adhesive or a supporting sheet. The supporting sheet is attached just under the tip of a real finger, then a thermoset material (mainly acrylic type) is then applied little by little onto the natural fingernail from the cuticle of the natural finger and sculpted to cover the whole artificial fingernail tip or a portion of the supporting sheet, such that a uniform extended surface is created. This process is repeated for each finger. Once the thermoset material dries naturally or under ultraviolet lighting, intensive and abrasive filing is applied to create a desired shape for each fingernail. Since this method builds up an artificial fingernail by adding material little by little manually, it gained the name of "nail sculpture." The last step of this process is to paint the top surface of the artificial fingernails with nail polish to display the desired color or pattern.

Another method to create artificial fingernails is called "nail wrapping." In this method, fabric pieces are cut off and glued onto a natural fingernail. After a few layers of fabric are glued and dried, coats of filler material are applied to create a continuous uniform surface. After intensive filing to the desired shape, the nail can be polished. This process has to be repeated on each finger. Both nail sculpturing and nail wrapping expose the user and nail technicians to fumes, chemical liquids, and filing debris, which can present health and respiratory problems. In addition, the growth of a natural nail will create a gap between its cuticle and applied artificial fingernail since the artificial fingernail, once applied, is bonded onto the natural nail surface. This gap needs to be filled regularly, and this process requires a great deal of time and money.

A less expensive alternative to the nail sculpturing and nail wrapping methods is the pre-made artificial fingernail tips with nail art already in place that are capable of being pasted onto the natural fingernail. However, such mass-produced artificial fingernail tips have limited choices in their shapes, lengths, styles and fit. A person's fingernail is different from another person's in its cuticle, width, length, and three-dimensional (3D) shape. Therefore, mass-produced artificial fingernail tips cannot fit exactly to a user's natural fingernail. Usually, such an artificial fingernail tip is forced onto a natural fingernail surface, and glued on with an adhesive. This poses the problem that such an artificial fingernail tip can be peeled easily. In addition, this type of artificial fingernail tip is usually recognized as false due to the unfitted shape at the margins.

Another option that solves the problems encountered in the existing pre-made artificial fingernail tips and the nail sculpturing and nail wrapping methods as described above, is to custom manufacture every artificial fingernail tip. This process may consist of creating a plaster mold from a series of precise impressions of a natural fingernail, then the mold can be used to create an artificial fingernail by either injection molding or casting. The creation of artificial nails by using this process is still time consuming, costly and requires considerable work to turn the rough cast into the finished product. It is also impractical to perform this process in a nail salon environment.

Other proposed processes require contact with the person's fingernail to measure the fingernail for custom fitting. These systems would inherently be less accurate than non-touch measuring systems and require a mechanical apparatus that can be prone to malfunction.

SUMMARY OF THE INVENTION

In accordance with the present invention, a preferred embodiment provides an artificial fingernail production system for creating custom fit artificial fingernails. In another aspect of the present invention, the system comprises a non-contact measuring system for measuring dimensions of a fingernail wherein the non-contact measuring system comprises a non-contact measuring device for measuring a three-dimensional topography of a fingernail. A further aspect of the present invention employs a machining device for creating an artificial fingernail using the three-dimensional topography of the fingernail wherein the resulting artificial fingernail custom fits the fingernail. Yet another aspect of the present invention provides a light source for emitting a white light onto the fingernail and a camera for recording an image of the fingernail. In a further aspect of the present invention, the light source may project a grid onto the fingernail and take a picture of the grid for calculating the three-dimensional topography. In a separate embodiment a laser can be used as the light source for scanning the surface of the fingernail. Data from either the white light embodiment or the laser embodiment of the light source is converted into a three-dimensional topographical data structure for the fingernail. In a further aspect of the invention, a preferred embodiment provides a process for custom designing an artificial fingernail comprising the steps of measuring a three-dimensional topography of a fingernail with a non-contact measuring system, selecting parameters for the artificial fingernail wherein the parameters include thickness, length and style of the artificial fingernail, and then calculating a three-dimensional shape of the artificial fingernail from the three-dimensional topography of the fingernail and the parameters for the artificial fingernail. In a preferred embodiment this process also includes machining the artificial fingernail for custom fitting the fingernail.

In operation, a system user for one aspect of the present invention presents a finger or fingers for custom measuring where a non-contact measuring device measures the topography of the fingernail for each finger. This can then be repeated for each other finger or fingers as desired. The resulting data from the measurement is converted into a three-dimensional image for viewing by the user together with a proposed artificial fingernail. The user is then allowed to select options for designing a customized artificial fingernail. Once the desired options are selected the three-dimensional data for the artificial fingernail is converted into a machine code and transferred to a machine such as a computer numerically controlled machine for cutting the artificial fingernail from a raw material into the desired shape that provides a custom fit to the system user.

Thus, a system and process is provided for quickly and accurately measuring and custom fitting artificial fingernails. The system offers the opportunity of measuring for, designing, and producing custom fingernails within a short period of time. The system is advantageously small and suitable for use in a salon where custom fingernail design is already offered.

Therefore, an advantage of the present invention is to provide a system and process for creating custom crafted artificial fingernail tips by using an automated system with a non-contact measuring system. A further advantage of the invention is to provide a safe, convenient, accurate, and rapid system for measuring the topographical shape and dimensions of a natural fingernail and producing a custom fit artificial fingernail. It is yet a further advantage of the present invention to provide a method to digitally design an artificial fingernail incorporating the digitized three-dimensional shape of a natural fingernail.

Further areas of applicability of the present invention will become apparent from the detailed description provided hereinafter.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiments is merely exemplary in nature and is in no way intended to limit the invention, its application, or uses.

Figure 1:
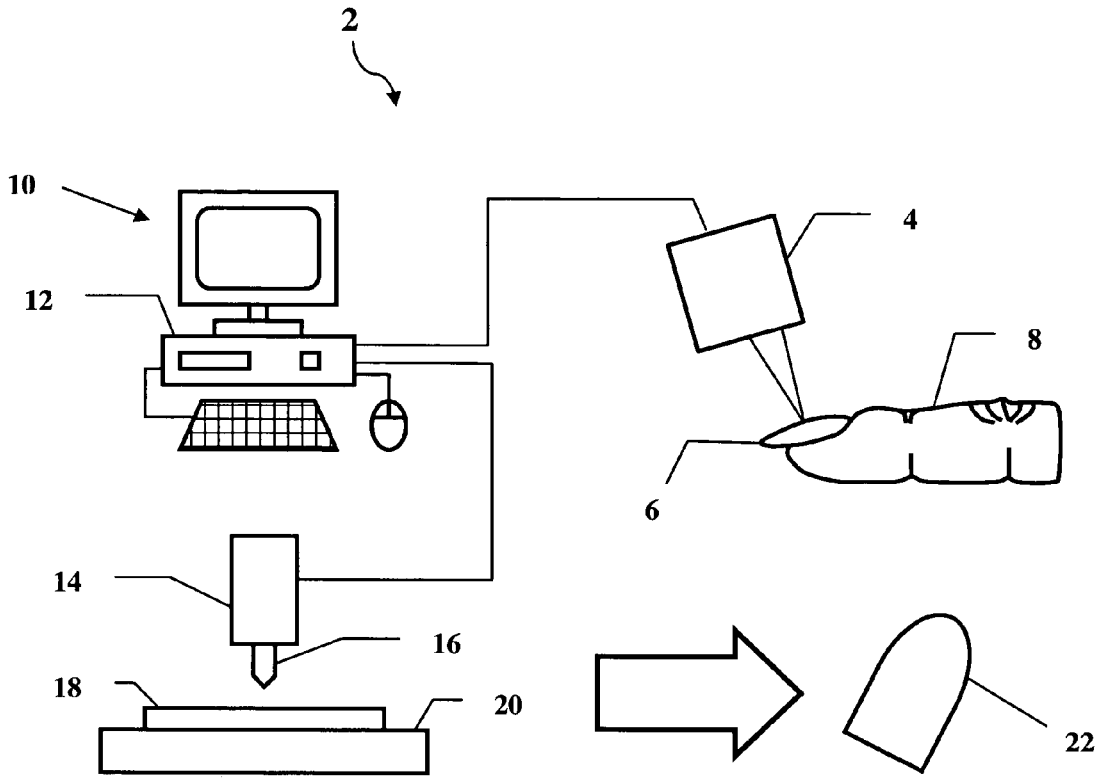
FIG. 1 is a diagrammatic view schematically illustrating the preferred embodiment of the artificial fingernail production system of the present invention.

Referring to FIG. 1, an artificial fingernail production system 2 of the present invention comprises an optical measuring device 4 for measuring the topography and dimensions of a fingernail 6 of a finger 8. The optical measuring device 4 is of the type known by those skilled in the relevant art. For example, the optical measuring device may be the type as disclosed in U.S. Pat. No. 5,175,601, entitled High-Speed 3-D Surface Measurement Surface Inspection and Reverse-CAD System, which is incorporated herein by reference. The optical measuring device 4 is connected to a measuring and design system 10 comprising a computer system 12. The measuring and design system 10 is connected to a machining device 14 with a machining tool 16 for machining a material 18 that is mounted on a base 20 into an artificial fingernail 22. The machining device 14 in an embodiment, is a computer-numerically-controlled (CNC) device such as known by those skilled in the relevant art. For example, the machining device 14 may be of the type that is disclosed in U.S. Pat. No. 5,493,502, entitled Numerical Control Unit for Controlling a Machine Tool to Machine a Workpiece at an Instructed Along Linear and Rotational Axes, which is incorporated herein by reference. The computer system 12 comprises a microprocessor based computer attached to a monitor, keyboard and pointing device, for example, a mouse. The computer has storage devices for example a hard drive and RAM for storing and reading application programs and data.

Figure 2:
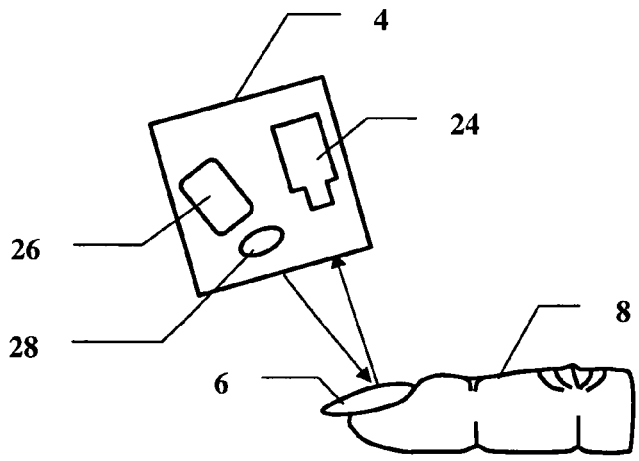
FIG. 2 is a diagrammatic view illustrating components of a measuring system of the present invention system.

Referring now to FIG. 2, the optical measuring device 4 of the artificial fingernail production system 2 comprises a camera 24, a light source 26 and a projection lens 28. The camera 24 is either an analog or digital video camera with an imaging capability as an area type or line type imager. The light source 26 is a white light for projecting a grid (not shown) onto the fingernail 6. While the grid is projected onto the fingernail 6, the camera 24 is used to take a picture or pictures of the grid. The picture or pictures are then transferred to the measuring and design system 10 for calculating the three-dimensional topography of the fingernail 6.

In a second preferred embodiment the light source 26 is a laser used to measure the three-dimensional topography of the fingernail 6. In this embodiment, the laser light source 26 scans a stripe across the fingernail 6 and the camera 24 records the image. A laser triangulation algorithm is then used to determine the three-dimensional topography of the fingernail 6. The laser scanning can be achieved by translating the light source 26 or by shifting the fingernail 6. Other ways of scanning the fingernail 6 with a laser light source 26 can alternately be used including by rotating a mirror (not shown) for rotatably scanning the laser across the fingernail 6 without movement of the light source 26. In either the white light embodiment of the light source 26 or the laser embodiment of the light source 26 the imaging and scanning process are advantageously brief, allowing a user of the artificial fingernail production system 2 to quickly scan and measure the three-dimensional topography of a plurality of fingernails.

When using the white light embodiment of the light source 26, the grid that is projected onto the fingernail 6 will deform in accordance with the topography of the fingernail 6. The deformations of the grid of the fingernail 6 are recorded by the camera 24 as a two-dimensional grid image. Different algorithms can be used to decode this two-dimensional deformed grid image into a three-dimensional topography of the fingernail 6. Algorithms for decoding the two-dimensional deformed grid image include: phase shifting; Fourier transforming; spatial coding; and Sinusoidal fitting. These algorithms will provide a phase map at the end of the calculation which is converted into three-dimensional coordinates for each pixel of the grid image. These calculations are performed by the measuring and design system 10. Both the laser scanning and white light grid methods will generate a set of points with known x, y, and z axis coordinates to represent the three-dimensional topography of the fingernail 6. The x, y, and z coordinates also define the boundary between the finger 8 and the fingernail 6. By using these non-contact methods, the total number of points measured for a fingernail can be easily over 200,000 points. The x, y, and z axis coordinates are saved in the computer system's 12 storage capacity in a digital format.

The boundary of the fingernail 6 can be determined by one of the following ways: (1) drawing an outline of the fingernail 6 of the finger 8 on the screen of the computer monitor by using the pointing device; or (2) automatically determining the boundary of the fingernail 6 by a boundary extraction algorithm. Both methods are well known to those skilled in the relevant art.

Figure 6:
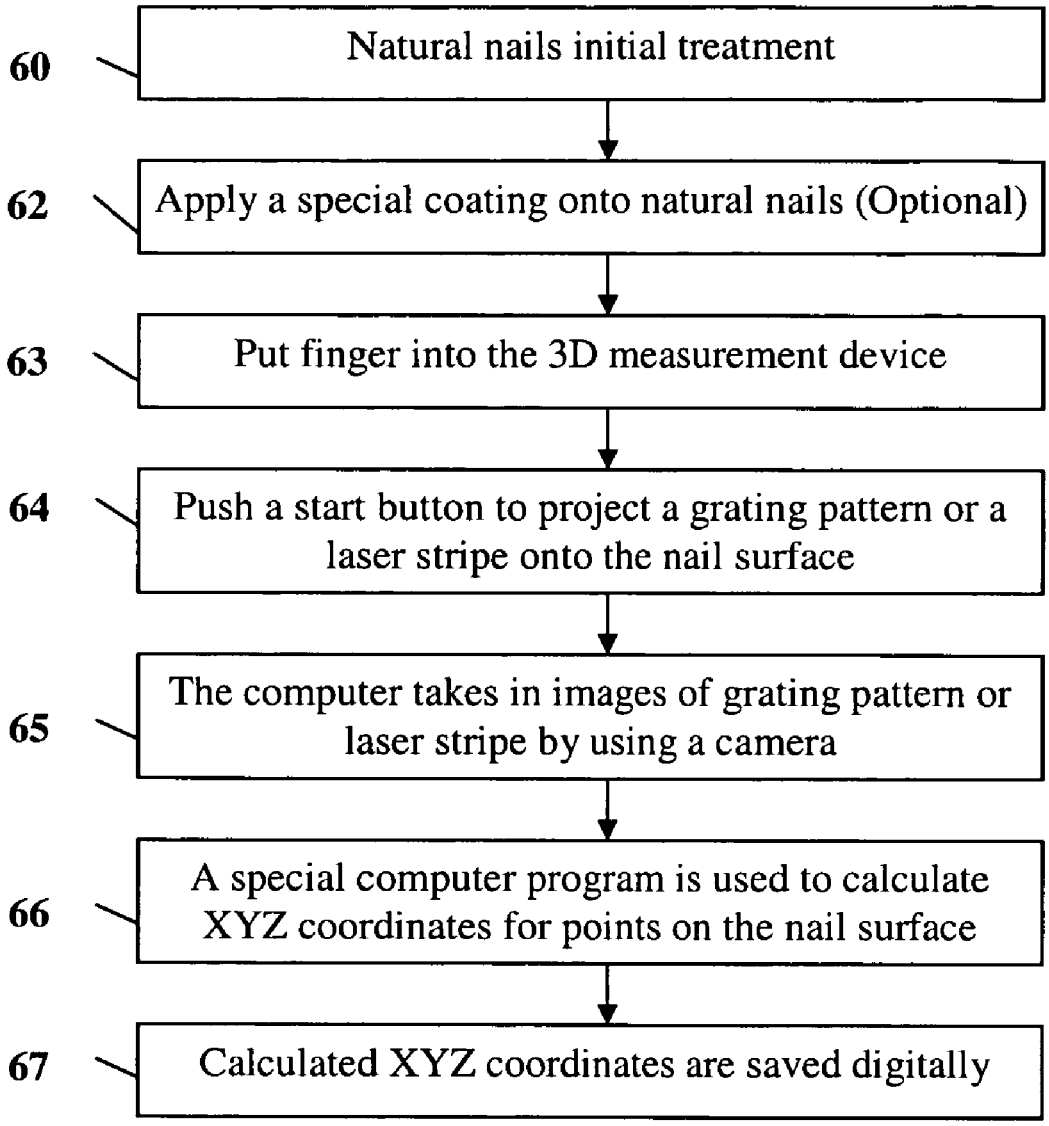
FIG. 6 is a flow diagram of the measurement process of the present invention system for measuring a natural fingernail.

Referring to FIG. 6 the process for creating a custom fit artificial fingernail with a non-contact measuring device starts in step 60 with the treatment of the fingernail 6 to allow a more accurate measurement of the fingernail 6. This involves removing excess cuticle and cutting the fingernail 6 to an appropriate length. Next, in step 62 the fingernail 6 is covered with a coating. The coating is applied to create an optically diffusive surface on the fingernail 6. Any suitable coating can be used. For example, a suitable coating is SKD-S2 from MagnaFlux™. Step 62 of applying the coating on the fingernail 6 is not required and can be omitted. Following this, in step 63 the fingernail 6 is placed in the optical measuring device 4 for measuring the three-dimensional topography of the fingernail 6. The optical measuring device 4 is then activated in step 64 and in step 65 the optical measuring device 4 takes an image of the fingernail 6 with the camera 24 while a grid or laser beam is projected onto the fingernail 6. Then in step 66 the measuring and design system 10 calculates x, y, and z coordinates for the fingernail 6. Finally, in step 67 the calculated coordinates are saved to the computer system 12 of the measuring and design system 10.

Figure 3A:
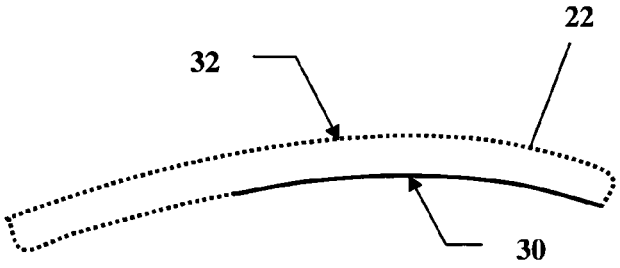
FIG. 3A is a cross sectional view along the nail length direction of an artificial fingernail of the present invention system.
Figure 3B:
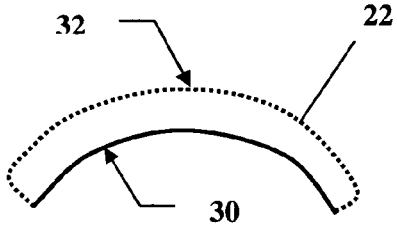
FIG. 3B is a cross sectional view along the nail width direction of the artificial fingernail of the present invention system.
Figure 3C:
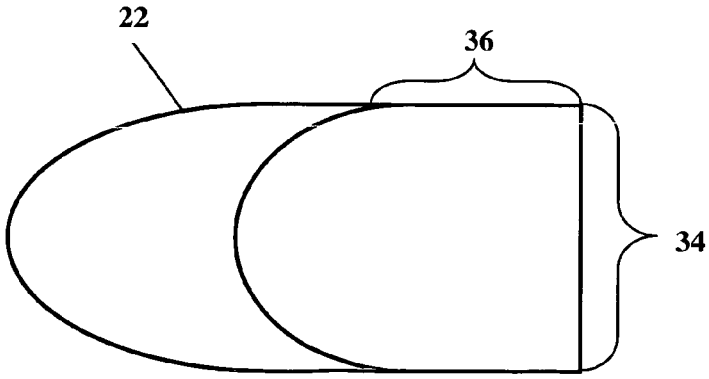
FIG. 3C is a top elevational view of the artificial fingernail of the present invention system.

After the measurement of the fingernail is done the next step is the design of the artificial fingernail 22. The artificial fingernail 22 will have at least a portion of its undersurface that matches at least a portion of the corresponding fingernail 6. Referring briefly to FIGS. 3A, and 3B, the artificial fingernail 22 has an underside 30 (with a solid line representing the portion that conforms to the topographical surface of the fingernail 6). A top side 32 of the artificial fingernail 22 (shown in broken line) corresponds to the portion of the artificial fingernail 22 that is custom designed as part of the processes of the invention. Referring to FIG. 3C, a back 34 and side 36 of the artificial fingernail 22, match the outer boundary of the fingernail 6 on the finger 8. Since only the underside 30 of the artificial fingernail 22 matches the three-dimensional topography of the fingernail 6 the remaining portion may be advantageously designed in whatever shape is desired.

Figure 7:
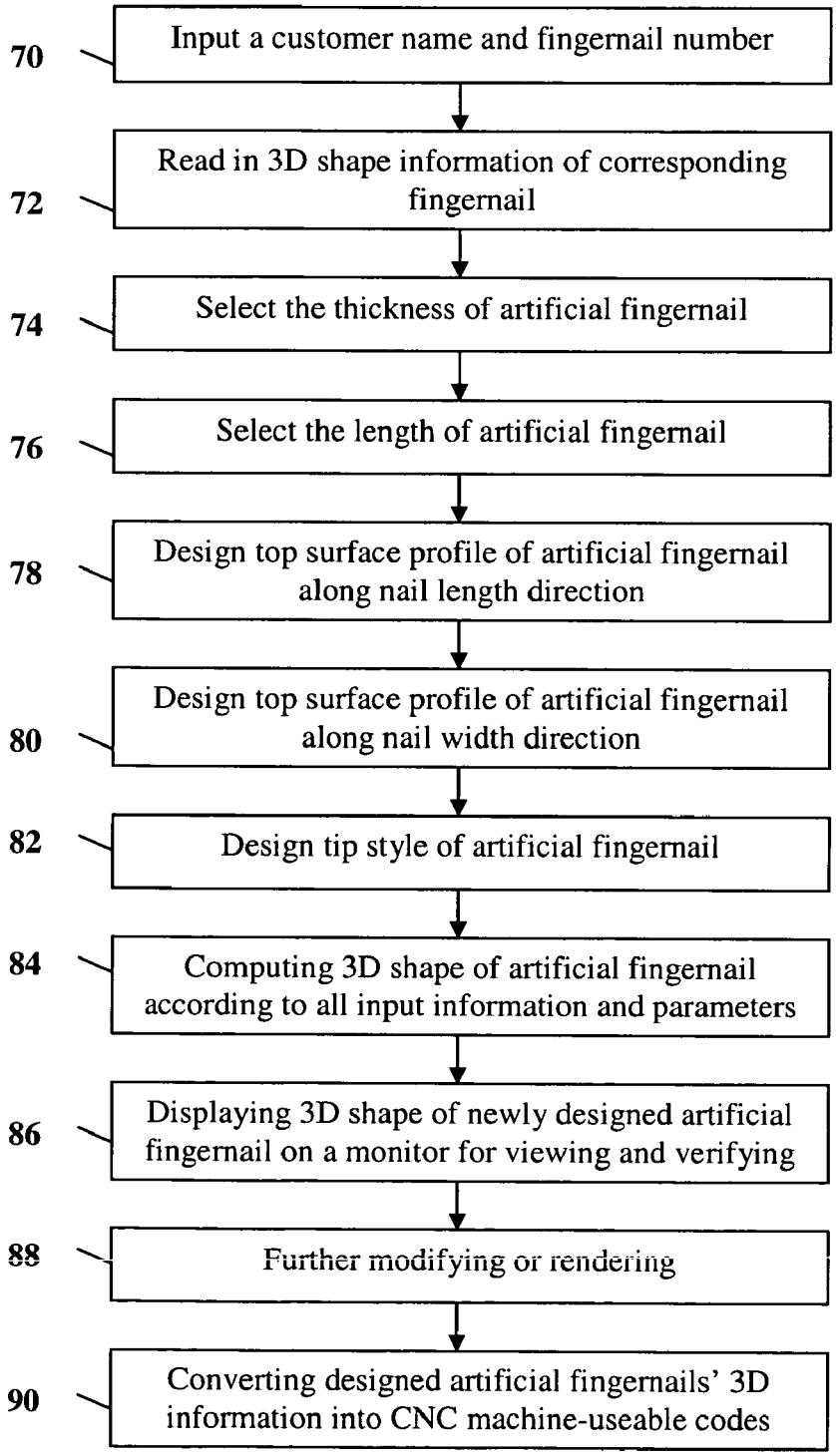
FIG. 7 is a flow diagram of the computer logic employed in the present invention system for how to design the shape of the artificial fingernail.

Now referring to FIG. 7, a design process is used to carry out the digital design of the artificial fingernail 22. This includes a first step 70 of inputting a customer name and fingernail number into the measuring and design system 10 for matching to and uniquely identifying the three-dimensional topographical measurement of the fingernail 6. In step 72 the three-dimensional topographical information of the fingernail 6 is then selected. Next, a desired thickness in step 74 and a length in step 76 of the artificial fingernail 22 are selected. Following this, the design profiles for the top side 32 of the artificial fingernail 22 in both nail length, in step 78, and width, in step 80, directions are selected. Next, the style in step 82 of the artificial fingernail 22 is selected. With the information selected pursuant to steps 74–82 the artificial fingernail shape can be calculated in step 84 based on the input parameters and the three-dimensional topographical data for the fingernail 6.

Figure 4:
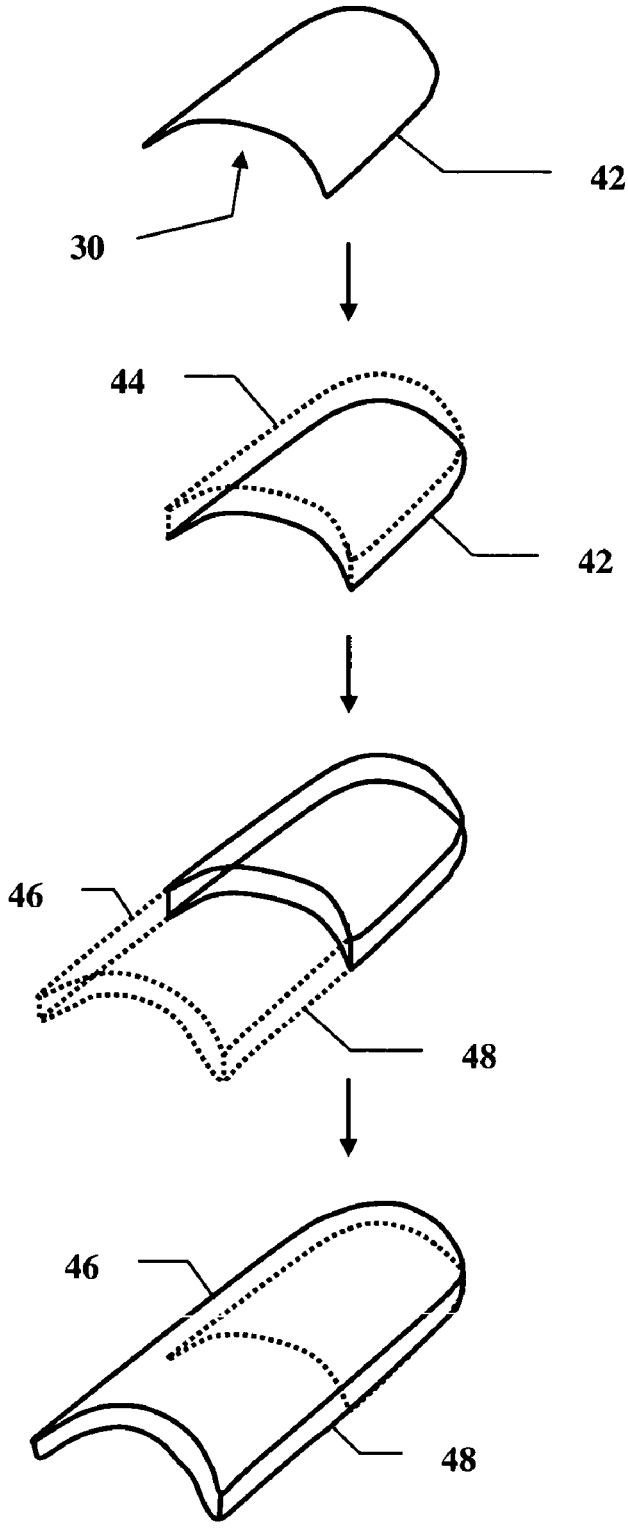
FIG. 4 is a diagrammatic view illustrating the steps employed in the process of the present invention system for digitally creating artificial fingernails.

FIG. 4 illustrates the steps for creating a three-dimensional data structure for the artificial fingernail 22. Illustrated first is a representation of the three-dimensional topographical data 42 that defines the topography of the fingernail 6. A top surface 44 is created from this based on the selected thickness and the chosen top surface profiles in both nail length and width directions. Next, the top surface 44 and the underside 30 formed from the three-dimensional topographical data 42 are used to define an extended top surface 46 and an extended undersurface 48. This step completes the process to create an artificial fingernail 22 which now has an integral extended top surface 46.

Returning to FIG. 7, after a three-dimensional model of the artificial fingernail 22 has been created, it will be displayed for viewing and verifying purposes in step 86. If necessary, modifications to the display design can be performed as indicated in step 88.

After the three-dimensional design of the artificial fingernail 22 is approved, the design system 40 will use the three-dimensional data structure of the resulting three-dimensional model of the artificial fingernail 22 to generate machine usable codes for machining an artificial fingernail as indicated in step 90.

Figure 5:
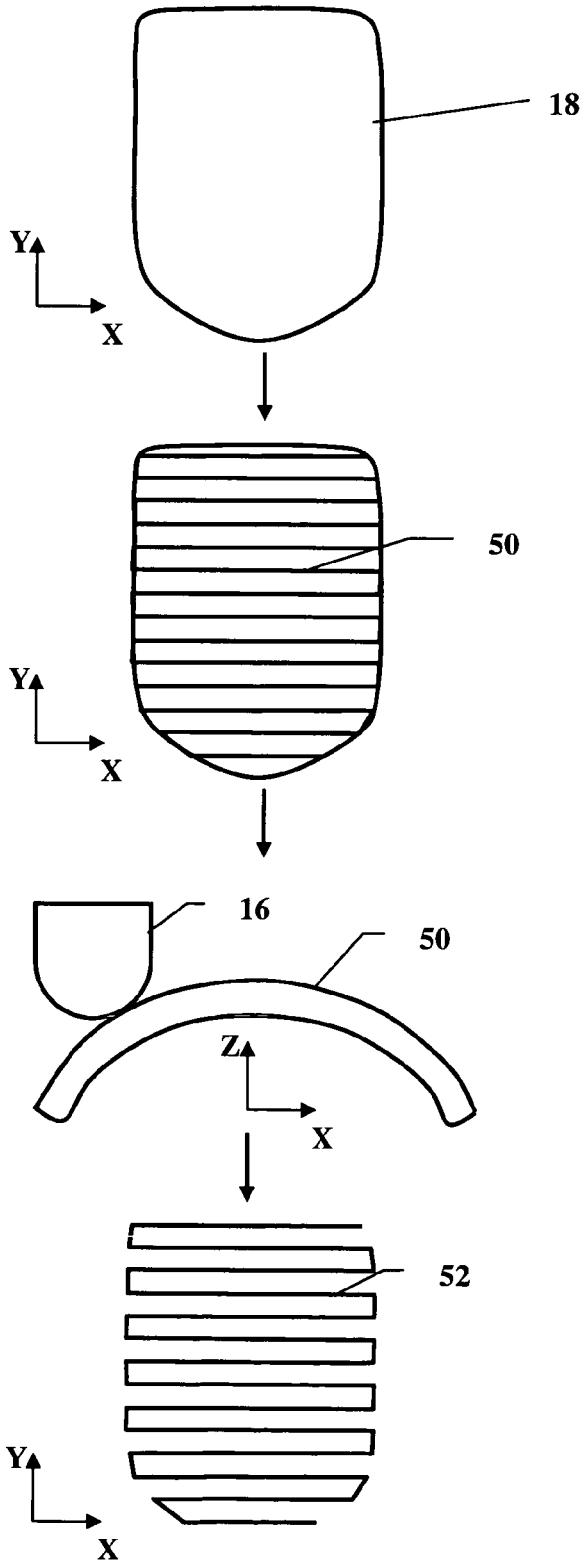
FIG. 5 is a diagrammatic view illustrating the steps of creating CNC machine usable codes in the present invention system.

Referring to FIG. 5, a machining process of the artificial fingernail production system 2 starts with providing a material 18 for machining. A series of cross-sectional lines 50 are generated along either the intended nail width or nail length direction at a predetermined spacing. Based on the profile of the cross-sectional lines, the best position of the machining tool 16 is calculated at certain step sizes to create a three-dimensional cutter path 52. Finally, the three-dimensional cutter path 52 data is saved as a series of codes in a form readable by a machining device 14 such as a CNC machine.

The material 18 for making the artificial fingernail 22 can advantageously be any desirable and suitable plastic, metal or other material.

Figure 8:
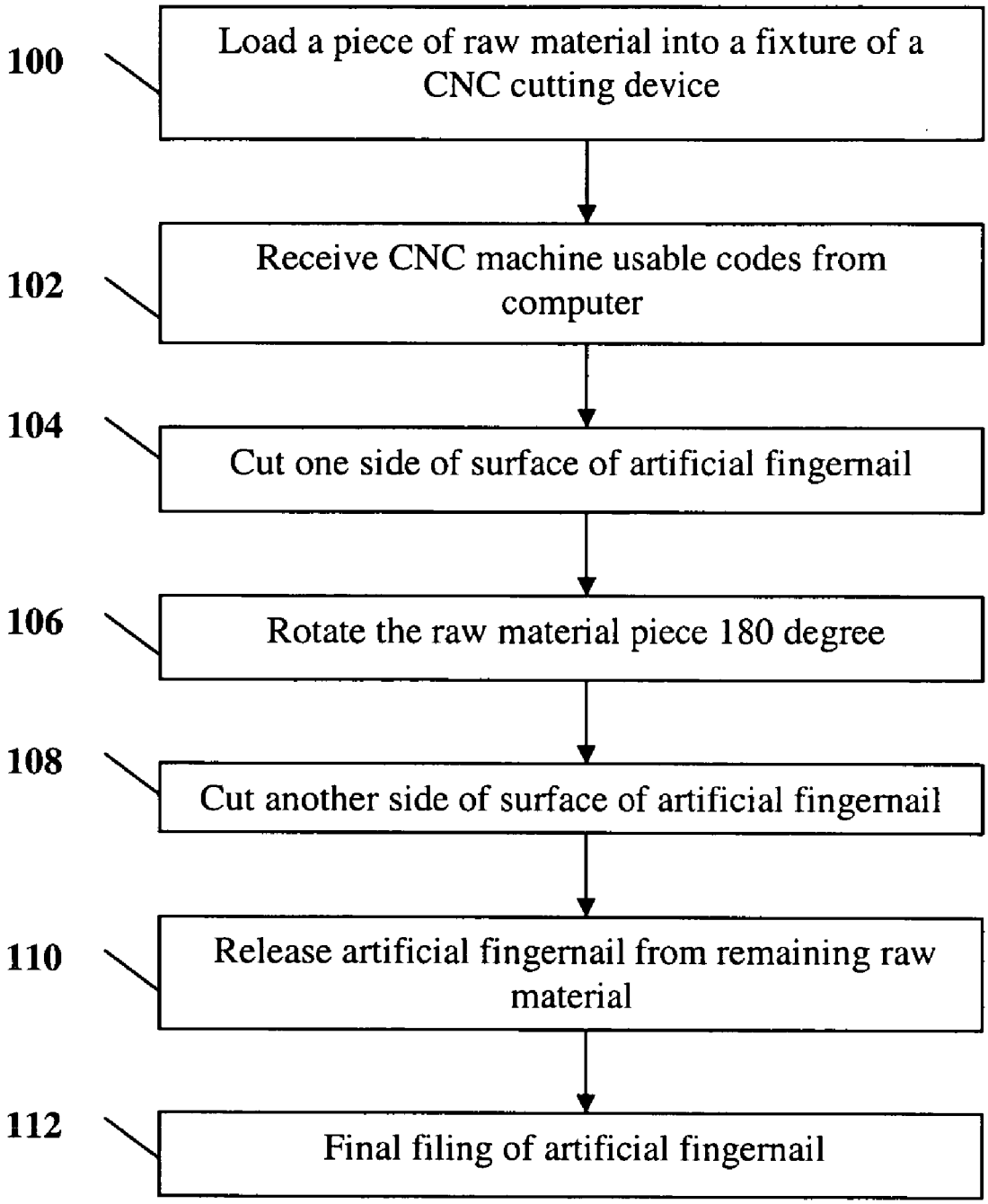
FIG. 8 is a flow diagram of the machining process of the present invention system for the artificial fingernails.

The machining device 14 will have at least three motor-driven translation axes perpendicular to each other. The machining tool 16 is capable of being controllably positioned along at least two perpendicular directions. The material 18 is provided in a rectangular shape with a length, width and height sufficient to accommodate the finished artificial fingernail 22. Referring to FIG. 8, in a first step 100 of the machining process, the material 18 is loaded into the machine device 14 (the CNC machine). Next, in step 102, machine usable codes created in step 90 are received by the machining device 14. Next, in step 104, one side of the surface of the material 18 for the artificial fingernail 22 is cut. This is followed in step 106 by rotating the material 18, 180 degrees for cutting, in step 108, the other side of the artificial fingernail 22. In step 104 and step 108, two dimensional or three dimensional decorative designs or indicia, e.g. numbers, letters, etc., can be machined. The artificial fingernail 22 is next released from any remaining material 18 in step 110. Finally, in step 112, any necessary finish filing of the artificial fingernail 22 is performed. Thus, an artificial fingernail 22 of the artificial fingernail production system 2 is produced.

Figure 9:
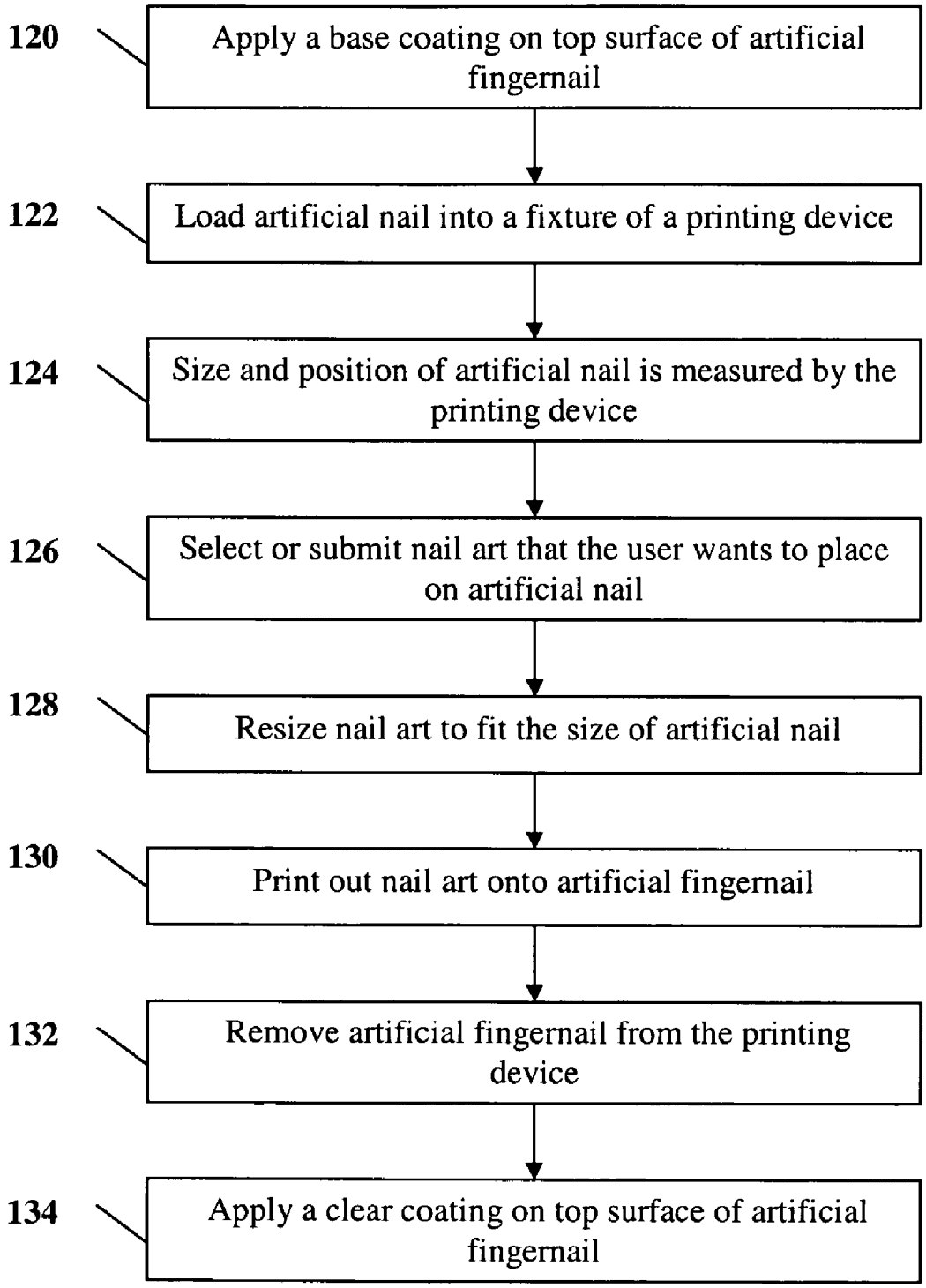
FIG. 9 is a flow diagram of applying nail polish or creating nail art onto the artificial fingernail of the present invention system.

Referring to FIG. 9 the artificial fingernail can next be coated with a design using an inkjet printing apparatus. The inkjet printing apparatus can be for example an inkjet printer by ImagiNail™ Corporation. In a first step (120) a base coat is applied on the top surface of the artificial fingernail 22 before any nail art can be printed by using an inkjet printing apparatus. The base coating is used as a color-receiving agent to prevent ink from smearing. After the base coating dries, the artificial fingernail can be loaded into the inkjet printing apparatus. Desired nail art has to be chosen from a digital nail art collection saved on the computer system 12. Alternatively, nail art can be provided in a digital picture format in step 126. The inkjet printing apparatus will sense the size and position of the loaded artificial fingernail in step 124, and will resize the chosen nail art to match the size of the artificial fingernail in step 128. After confirmation, the nail art can be printed out onto the artificial fingernail surface in step 130. The inkjet printing apparatus has at least two motor-driven axes, and multiple color ink tanks. After removing the artificial fingernail from the inkjet printing apparatus in step 132, the final step is to apply a clear coating on the artificial fingernail to protect the nail art in step 134.

The preferred embodiments disclosed are used in conjunction with fingernails, but it is clearly within the purview of the invention to use the system to cover toenails as well. Accordingly, the invention has been described by way of illustration rather than limitation. The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A system for creating a custom fit, three-dimensional artificial fingernail wherein a portion of the artificial fingernail at least semi-rigidly retains a shape that substantially matches a top surface of a natural fingernail, the system comprising:

a non-contact measuring system operably measuring a three-dimensional topography of a natural fingernail, the measuring system comprising a light source and a camera;

a design system for designing the three-dimensional shape of the artificial fingernail by offering the selection of parameters comprising length, and three-dimensional style, of the artificial fingernail;

a calculation module within the design system for calculating a three-dimensional design of the artificial fingernail from the three-dimensional topography of the natural fingernail and the selected parameters; and a machining device operably creating the artificial fingernail using the three-dimensional design of the artificial fingernail, the artificial fingernail at least semi-rigidly retaining a shape that substantially matches the top surface of the natural fingernail.

2. The system of claim 1 wherein the light source projects a pattern on the natural fingernail, the camera records a two-dimensional grid image of the natural fingernail and the design system calculates x, y, and z coordinates of the natural fingernail topography.

3. The system of claim 1 wherein the light source is a laser, and the non-contact measuring system scans the natural fingernail and calculates the three-dimensional topography of the natural fingernail.

4. The system of claim 1 wherein the non-contact measuring system converts the three-dimensional topography of the natural fingernail into a machine code for the machining device.

5. The system of claim 1 wherein the machining device is a computer numerical control device for receiving machine data for milling a material into the artificial fingernail.

6. An artificial fingernail manufactured by the system of claim 1.

7. A process for custom designing an artificial fingernail for use with a natural fingernail, the process comprising the steps of:

calculating x, y, and z data points of the natural fingernail with a non-contact measuring system;

selecting parameters for the artificial fingernail, wherein the parameters selected comprise length, and style;

calculating a three-dimensional shape of the artificial fingernail from the x, y, and z data points of the natural fingernail and the parameters for the artificial fingernail; and machining the artificial fingernail wherein the artificial fingernail custom fits the natural fingernail.

8. The process of claim 7 further comprising the step of:

converting the three-dimensional shape of the artificial fingernail into a machine data for the machining of the artificial fingernail.

9. The process of claim 8 wherein the machine data are machine codes.

10. The process of claim 7 further comprising the step of:

displaying the three-dimensional shape of the artificial fingernail before the step of machining the artificial fingernail.

11. A computer implemented process for designing custom artificial fingernails for fitting a natural fingernail based on an optical image of the natural fingernail, the process comprising the step of:

receiving from an optical imaging device image data defining a surface of a finger comprising a surface of a natural fingernail;

extracting from the image data a portion of image data that defines x, y, and z data points of the surface of the natural fingernail;

selecting a design for the artificial fingernail;

creating a three-dimensional data structure for the artificial fingernail wherein the data structure comprises the x, y, and z data points that defines the surface of the natural fingernail and the design for the artificial fingernail; and converting the three-dimensional data structure into machine data for cutting the artificial fingernail out of a material.

12. The process of claim 11 wherein the image data defines a surface of a plurality of fingers comprising a plurality of surfaces of natural fingernails.

13. The process of claim 11 wherein the step of selecting a design for the artificial fingernail further comprises the steps of:

selecting a length of the artificial fingernail;

selecting a thickness of the artificial fingernail; and selecting a style of the artificial fingernail.

14. The process of claim 11 wherein the step of creating a three-dimensional data structure further comprises the steps of:

defining a top surface of the artificial fingernail wherein a portion of the top surface corresponds to the boundary of the surface of the natural fingernail;

defining a length of the artificial fingernail;

defining a thickness of the artificial fingernail; and defining a style of the artificial fingernail.

15. The process of claim 11 wherein the three-dimensional data structure is converted into machine codes readable by a computer numerically controlled device for cutting the artificial fingernail out of the material.

16. The process of claim 11 wherein the machine data are machine codes suitable for a computer numerically controlled machine.

17. A computer implemented process for designing custom three-dimensional artificial fingernails for fitting natural fingernails based on an optical image of the natural fingernails, the process comprising the step of:

receiving from an optical imaging device image data defining a surface of a plurality of fingers comprising a surface of a plurality of natural fingernails;

extracting from the image data portions of image data that define the surfaces of the plurality of natural fingernails;

selecting at least one design for a plurality of artificial fingernails;

creating a plurality of three-dimensional data structures one for each of the plurality of artificial fingernails wherein each data structure comprises the data that defines one of the surfaces of each of the plurality of natural fingernails and the design for the artificial fingernail; and converting the three-dimensional data structures into machine data for cutting the plurality of artificial fingernails out of a material.

18. The computer implemented process of claim 17 wherein the machine data are machine codes suitable for a computer numerically control machine.

* * * * *

UNITED STATES PATENT AND TRADEMARK OFFICE

CERTIFICATE OF CORRECTION

PATENT NO. : 7,123,983 B2
APPLICATION NO. : 10/712547
DATED : October 17, 2006
INVENTOR(S) : Teruaki Yogo et al.

It is certified that error appears in the above-identified patent and that said Letters Patent is hereby corrected as shown below:

Col. 10, claim 18 line 22 "control" should be --controlled--

Signed and Sealed this

Tenth Day of April, 2007

JON W. DUDAS
*Director of the United States Patent and Trademark Office*